US006506099B1

(12) United States Patent
Bartlett

(10) Patent No.: US 6,506,099 B1
(45) Date of Patent: Jan. 14, 2003

(54) DRIVING A CARRIER HEAD IN A WAFER POLISHING SYSTEM

(75) Inventor: William R. Bartlett, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/543,395

(22) Filed: Apr. 5, 2000

(51) Int. Cl.[7] ..... B24B 1/00
(52) U.S. Cl. ..... 451/41; 45/285; 45/398
(58) Field of Search ..... 451/41, 285, 286, 451/287, 289, 290, 270, 271, 275, 398

(56) References Cited

U.S. PATENT DOCUMENTS 5,582,534 A * 12/1996 Sheldon et al. ..... 451/41
5,599,423 A 2/1997 Parker et al.
5,820,448 A * 10/1998 Shamouilian et al. ..... 451/287
5,899,800 A * 5/1999 Sheldon ..... 451/287
5,951,373 A 9/1999 Shendon et al.
6,184,139 B1 * 2/2001 Adams et al. ..... 438/691

FOREIGN PATENT DOCUMENTS

WO WO 96/36459 11/1996

* cited by examiner

*Primary Examiner*—George Nguyen
*Assistant Examiner*—Dung Van Nguyen
(74) *Attorney, Agent, or Firm*—Fish & Richardson

(57) ABSTRACT

A wafer polishing apparatus includes a carrier head 50 having a central axis 70 and a drive shaft 52 coupled to the carrier head. A first input pulley 86 or input gear 86A is coupled to the drive shaft to drive the carrier head about its central axis. A second input pulley 72 or input gear 72A is coupled to the carrier head to drive the carrier head in a circular path about a point that is offset from the central axis of the carrier head. A controller 84, can regulate speeds of the input pulleys or input gears while the wafer 10 is held in contact with a polishing pad 30. Rotation of the carrier head about a point that is offset from the axis of the carrier head can sweep the carrier head across the larger area of the polishing pad. The sweeping motion of the carrier head across the pad can help randomize non-uniformities in the pad and can reduce the amount of wear to the pad as the wafer is moved across it.

21 Claims, 6 Drawing Sheets

DRIVING A CARRIER HEAD IN A WAFER POLISHING SYSTEM

BACKGROUND

The invention relates generally to driving a carrier head in a wafer polishing system.

Wafer polishing techniques, such as chemical mechanical polishing (CMP), are used to planarize the surface of a semiconductor or other wafer. One or more layers previously may have been formed on the surface of the wafer. CMP techniques, for example, typically include mounting the wafer on a carrier or polishing head. The exposed surface of the wafer is placed against a rotating polishing pad. The carrier head provides a controllable load, in other words pressure, on the wafer to push it against the polishing pad. A polishing slurry is supplied to the surface of the polishing pad.

The effectiveness of a CMP process can be measured by its polishing rate, and by the resulting finish (absence of small-scale roughness) and flatness (absence of large-scale topography) of the wafer surface. The polishing rate, finish and flatness are determined by the pad and slurry combination, the relative speed between the wafer and pad, and the force pressing the wafer against the pad.

Various non-uniformities in the polishing process can adversely affect the quality of the polished wafers. Such non-uniformities may result from changes in the condition of the polishing pad. For example, the pad may become glazed in regions where the wafer was pressed against it. Such a condition may cause parts of the pad to become less abrasive and can result in the polishing process varying from one wafer to the next.

SUMMARY

In general, a wafer polishing apparatus includes a carrier head having a central axis and a drive shaft coupled to the carrier head. A first input pulley is coupled to the drive shaft to drive the carrier head about its central axis. A second input pulley is coupled to the carrier head to drive the carrier head in a circular path about a point that is offset from the central axis of the carrier head. A controller can be provided to regulate the speeds of the pulleys.

In various implementations, the apparatus can include one or more of the following features. The controller can be operable to cause the carrier head to move in the circular path while the carrier head rotates about its central axis. The controller also can be operable to cause movement of the carrier head in the circular path at a speed that is independently controllable from the speed at which the carrier head is rotated about its central axis. Furthermore, the controller can be operable to cause rotation of the carrier head about its central axis and movement of the carrier head in the circular path while the wafer is held in contact with a polishing pad that may be positioned, for example, on a platen. Various details of the apparatus and its operation are described in greater detail below.

In a related aspect, a method of polishing a wafer includes holding the wafer in a carrier head having a central axis, bringing the wafer into contact with a polishing pad. When the wafer is in contact with the polishing pad, the carrier head can be rotated about its central axis and simultaneously, the carrier head can be moved in a circular path about a point that is offset from the central axis of the carrier head. The carrier head can be moved in the circular path at a speed that is independently controllable from the speed at which the carrier head is rotated about it central axis.

In other implementations, the system of input pulleys and corresponding output pulleys coupled by belts can be replaced by input gears and corresponding driving gears.

Various implementations can include one or more of the following advantages. Rotation of the carrier head about its own axis can impart or enhance the relative motion between the polishing pad and the wafer. Additionally, rotation of the carrier head about a point that is offset from the carrier head's axis can sweep the carrier head across the larger area of the polishing pad. The sweeping motion of the carrier head across the pad can help randomize non-uniformities in the pad and can reduce the amount of wear to the pad. The techniques can be used in situations in which the polishing pad is stationary as well as when the pad is rotated.

Other features and advantages will be apparent from the following description, the accompanying drawings, and the claims.

DETAILED DESCRIPTION

Figure 1:
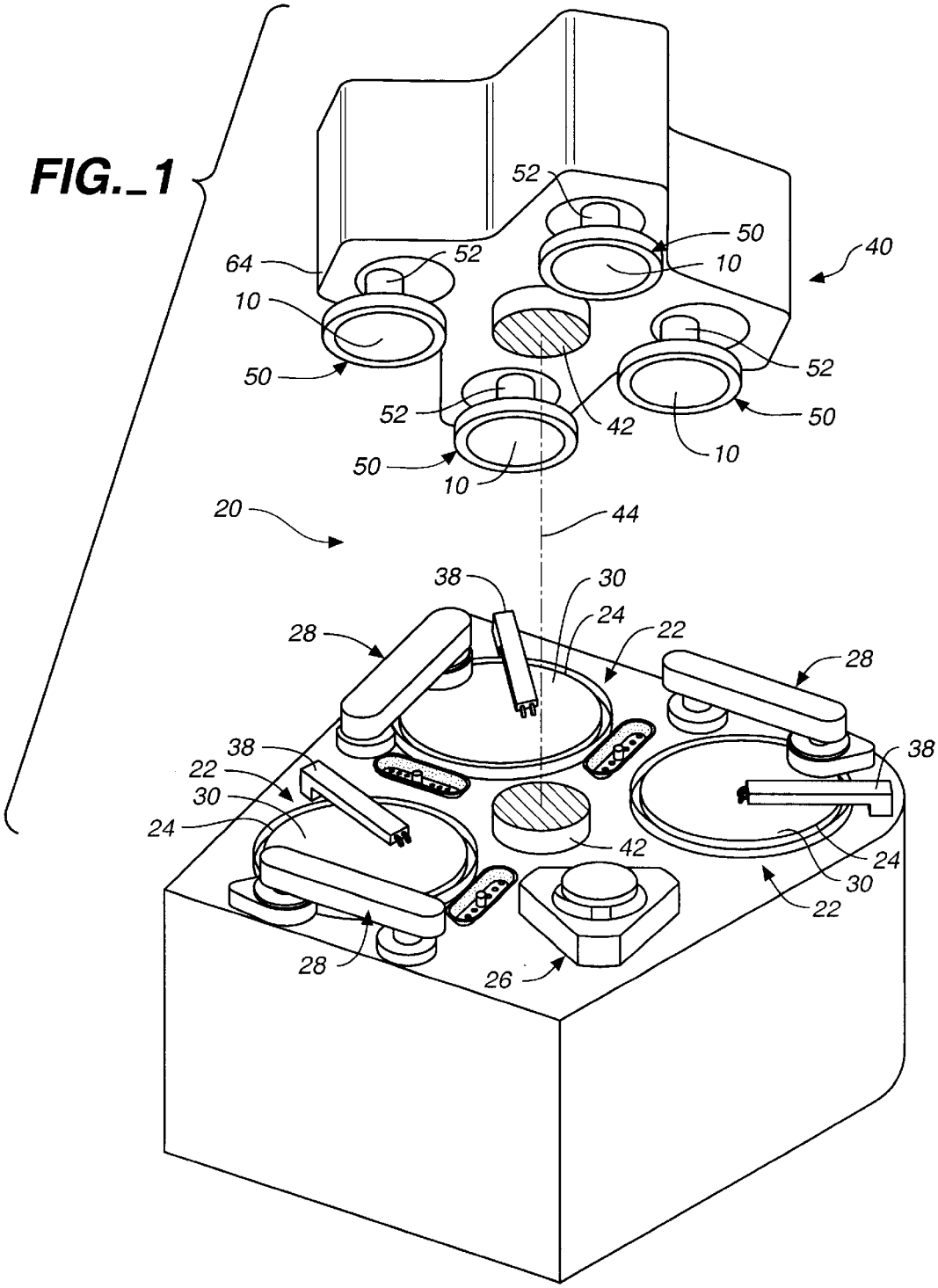
FIG. 1 is an exploded perspective view of a chemical mechanical polishing apparatus.

As shown in FIG. 1, multiple semiconductor wafers 10 can be polished by a chemical mechanical polishing (CMP) apparatus 20. Each wafer 10 may have one or more previously-formed films of layers. The polishing apparatus 20 includes a series of polishing stations 22 and a transfer station 26. The transfer station 26 can serve multiple functions, including receiving individual wafers 10 from a loading apparatus (not shown), washing the wafers, loading the wafers into carrier heads, receiving the wafers from the carrier heads, washing the wafers again, and finally, transferring the wafers back to the loading apparatus.

Each polishing station 22 includes a rotatable platen 24 on which is placed a polishing pad 30. Each platen 24 is connected to a platen drive motor (not shown) that can be used to rotate the platen. Each polishing station 22 also can include a pad conditioner 28 to maintain the condition of the polishing pad so that it will polish wafers effectively. Combined slurry/rinse arms 38 can supply slurry to the surface of the polishing pads 30.

A rotatable multi-head carousel 40 is supported by a center post 42 and is rotated about a carousel axis 44 by a carousel motor assembly (not shown). The carousel 40 includes four carrier head systems 50 each of which is attached to one end of a respective carrier head drive shaft 52 that extends downward from within the carousel. The center post 42 allows the carousel motor to rotate thecarousel 40 and to orbit the carrier head systems and the wafers about the carousel axis 44. Various pneumatic or hydraulic feed lines, electrical cables and drive motors can be enclosed within the carousel 40. Three of the carrier head systems can receive and hold wafers, and polish them by pressing them against the polishing pads 30. The fourth carrier head system can receive a wafer from and deliver a wafer to the transfer station 26.

Figure 2:
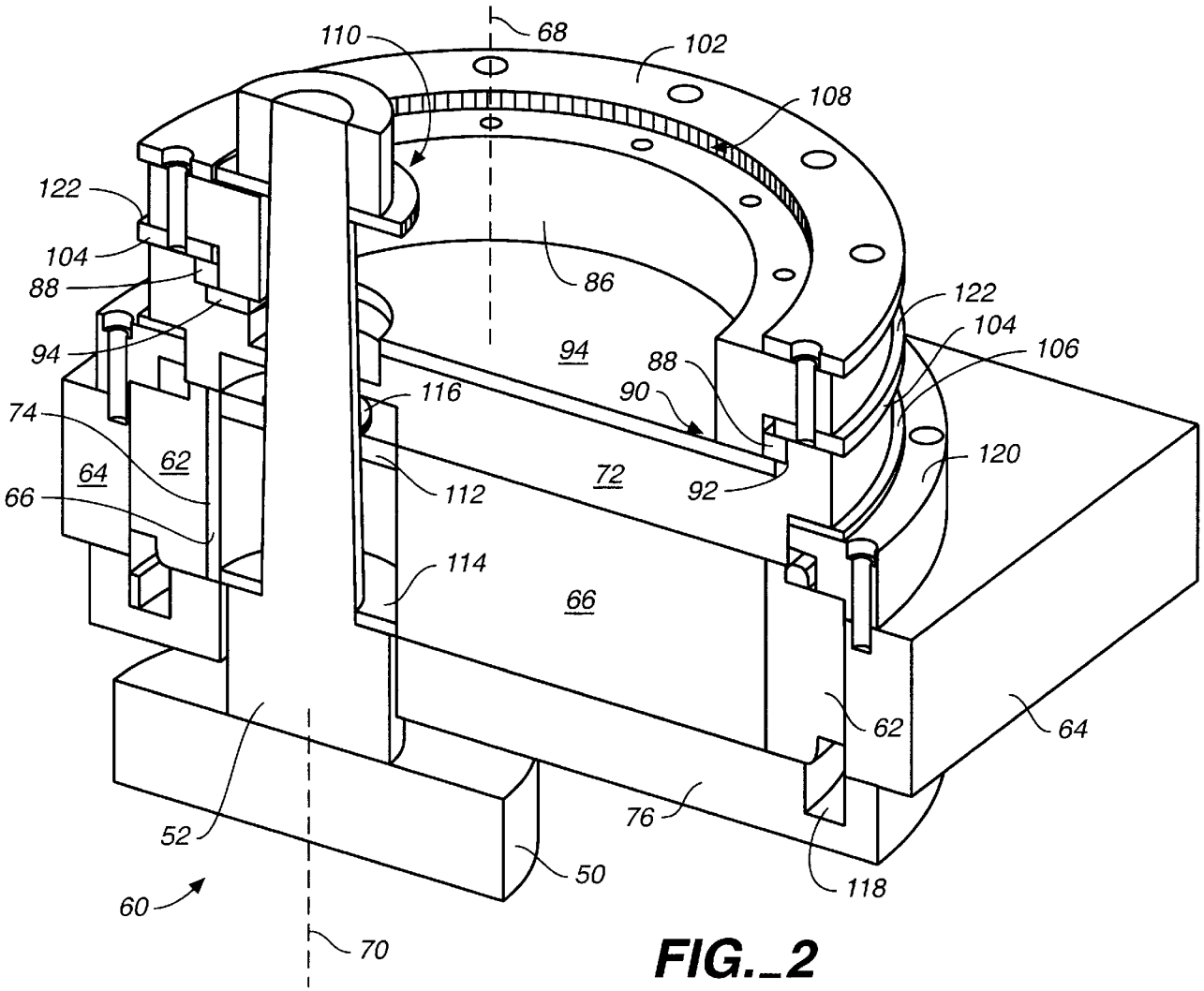
FIG. 2 illustrates a cross-sectional view of a carrier head drive system according to the invention.
Figure 3:
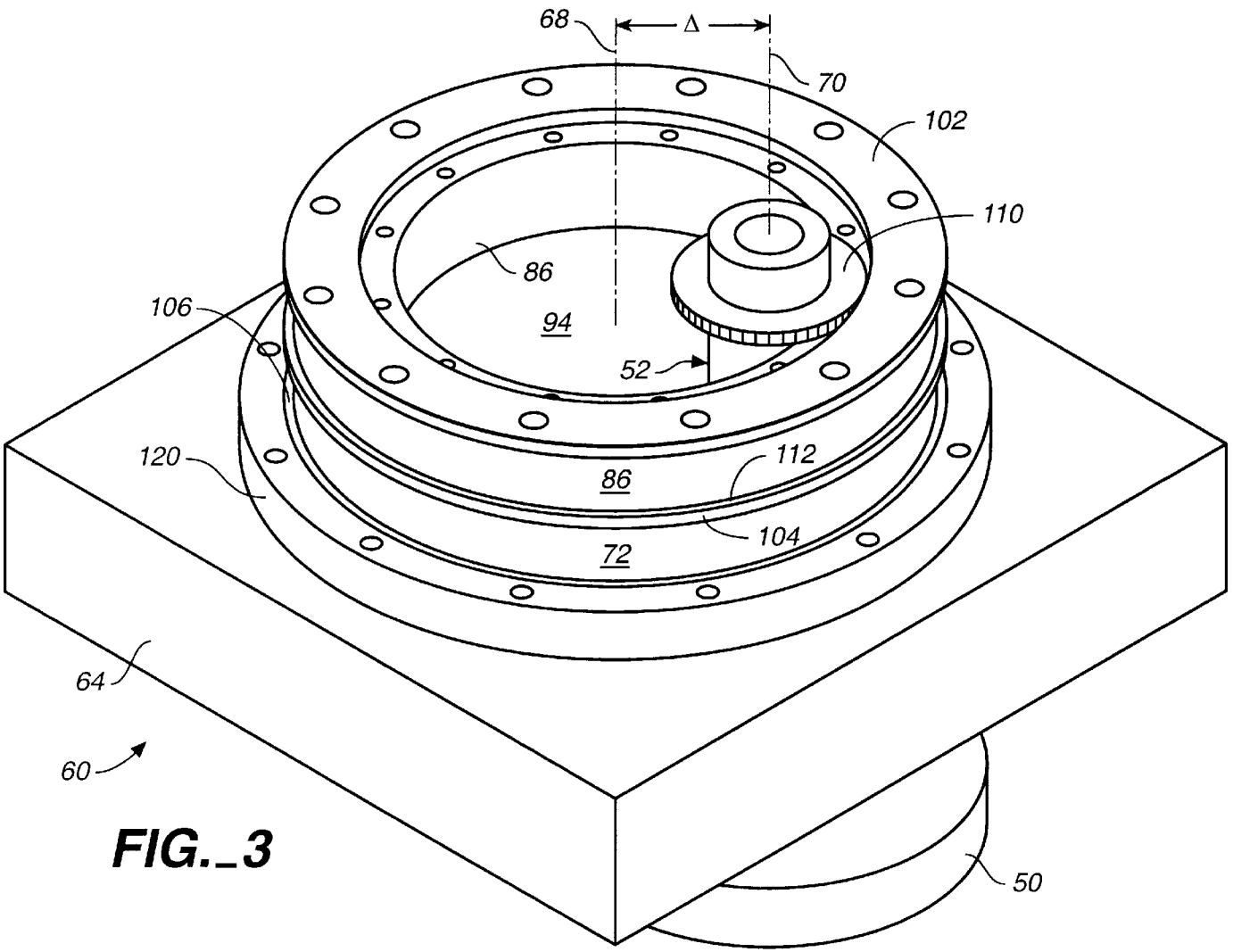
FIG. 3 illustrates another view of the carrier head drive system.

Further details of a system 60 for driving one of the carrier heads 50 are shown in FIGS. 2 and 3. The system 60 includes a large outer annular bearing 62 that can be rotated within a lower support plate 64 of the carousel 40. A large cylindrical plate 66 fits tightly within the outer bearing 62 and has a hole parallel to its main axis 68 through which the carrier head drive shaft 52 extends. As can be seen from FIG. 3, the major axis 70 of the carrier head drive shaft 52 is offset from the axis 68 by a distance. In general, the distance will depend on the particular requirements of the CMP system. However, in one exemplary implementation, the distance is on the order of about two to four inches. A lower input pulley 72, positioned above the cylindrical plate 66, traps the inner race 74 of the outer bearing 62 and helps clamp it to the cylindrical plate. A lower plate 76 is positioned directly beneath the cylindrical plate 66 and also helps clamp the inner race 74 of the outer bearing 62 to the cylindrical plate.

Figure 4:
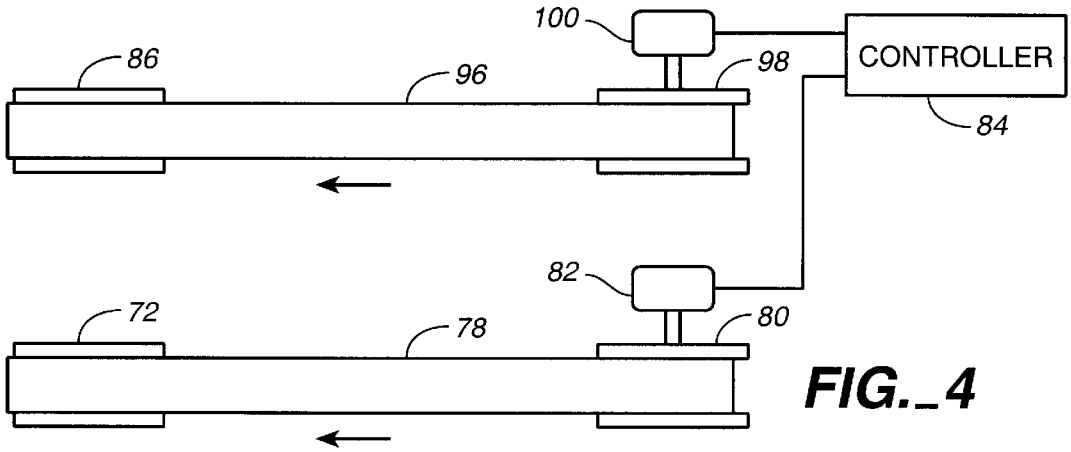
FIG. 4 illustrates schematically additional details of the carrier head drive system.

As shown in FIG. 4, a drive belt 78 extends between the lower input pulley 72 and a corresponding output pulley 80. A variable speed drive motor 82 is connected to the output pulley 80 and is controlled by a controller 84. Operation of the drive motor 82 causes the lower pulley 72 to rotate. As the lower pulley 72 rotates, the cylindrical plate 66 (FIG. 2) also rotates about the axis 68. Rotation of the cylindrical plate 66 causes the carrier head drive shaft 52 and, therefore, the entire carrier head 50, to move in a circular path about the axis 68. An annular flange 106 is positioned beneath the outer edge of the lower pulley 72 and helps prevent the belt 78 (FIG. 4) from slipping off the pulley.

As further shown in FIGS. 2 and 3, the drive system 60 also includes an upper input pulley 86 positioned above the lower pulley 72. An annular bearing 88 is positioned between a downwardly extending section 90 of the upper input pulley 86 and an upwardly extending section 92 of the lower input pulley 72. A thin circular plate 94 is positioned over the central section of the lower pulley 72 and clamps the inner race (not shown) of the bearing 88 against the upper pulley 86. The outer race (not shown) of the bearing 88 is seated against the lower pulley 72. An annular ring 104 helps clamp the outer race of the searing 88 against the lower pulley 72.

Another drive belt 96 (FIG. 4) extends between the upper pulley 86 and a corresponding output pulley 98. A variable speed drive motor 100 is connected to the output pulley 98 and is controlled by the controller 84. Operation of the drive motor 100 causes the upper pulley 86 to rotate. A ring 102 is positioned over the upper pulley 86 and serves as a flange to prevent the belt 96 (FIG. 4) from slipping off the pulley. Another flange 112 is positioned just below the outer edge of the upper pulley 86 and also helps prevent the belt 96 from slipping off the upper pulley.

The ring 102 positioned over the upper pulley 86 also serves as an outer gear for driving the carrier head drive shaft 52. In particular, an inner surface of the ring 102 has teeth 108 that mesh with corresponding teeth (not shown) on an inner gear 110 mounted about the top of the carrier head drive shaft 52. When the upper pulley 86 is rotated, the ring 102 rotates about the axis 68. Rotation of the ring 102 causes the inner gear 110 to rotate, thereby causing rotation of the carrier head drive shaft 52 about its axis 70. Two bearings 112, 114 are positioned about the carrier head drive shaft 52 and are located between the carrier head drive shaft and the cylindrical plate 66 to allow the carrier head drive shaft to rotate about the axis 70. Rotation of the carrier head drive shaft 52 about the axis 70 causes the carrier head 50 to rotate about the axis 70 as well.

A nut 116 helps hold the carrier head drive shaft 52 in its proper vertical position. Housings 118, 120 contain seals (not shown) that help prevent dirt and other contaminants from entering the system 60.

During polishing of a wafer 10, the controller 84 can control the speeds of the motors 82, 100 to control the speed at which the pulleys 72, 86 rotate and, therefore, to control the speed at which the carrier head 50 rotates about its axis 70 and the speed at which the carrier head rotates in a circular path about the axis 68. The pulleys 72, 86 can be rotated in the same direction or in opposite directions during polishing. Exemplary speeds for the spindle 52 and the carrier head 50 are in the range of about 60 to 120 revolutions per minute (rpm) about the axis 70. Similarly, exemplary speeds at which the carrier head 50 rotates about the axis 68 are in the range of about 10 to 400 rpm. Greater or lesser speeds may be appropriate and can be used in other implementations. A wafer 10 held by the carrier head 50 can be swept across the surface of the pad 30 during polishing as shown, for example, in FIGS. 5A through 5D.

In some implementations, the platen 24 (FIG. 1) and, therefore, the pad 30 are rotated about the central axis of the platen during polishing. Rotation of the platen 24 can provide relative motion between the pad 30 and a wafer 10 held by the carrier head 50 when the surface of the wafer is brought into contact with the pad. Rotation of the carrier head 50 about the axis 70 can enhance the relative motion between the pad 30 and the wafer 10. Additionally, rotation of the carrier head about the axis 68 sweeps the carrier head across the larger area of the pad 30. The sweeping motion of the carrier head 50 across the pad 30 can help randomize non-uniformities in the pad and can reduce the amount of wear to the pad. In situations where the platen 24 and pad 30 rotate during polishing, it often will be sufficient to cause the carrier head 50 to rotate about the axis 68 at relatively low speeds.

In other implementations, the platen 24 (FIG. 1) and, therefore, the pad 30 are held stationary during polishing. In such cases, rotation of the carrier head 50 about the axis 70 provides relative motion between the pad 30 and the wafer 10 held by the carrier head 50. Additionally, rotation of the carrier head about the axis 68 sweeps the carrier head across the larger area of the pad 30. As before, the sweeping motion of the carrier head 50 across the pad 30 can help randomize non-uniformities in the pad and can reduce the amount of wear to the pad. In situations where the platen 24 and pad 30 are held stationary during polishing, it often will be desirable to cause the carrier head 50 to rotate about the axis 68 at relatively high speeds.

Figure 7:
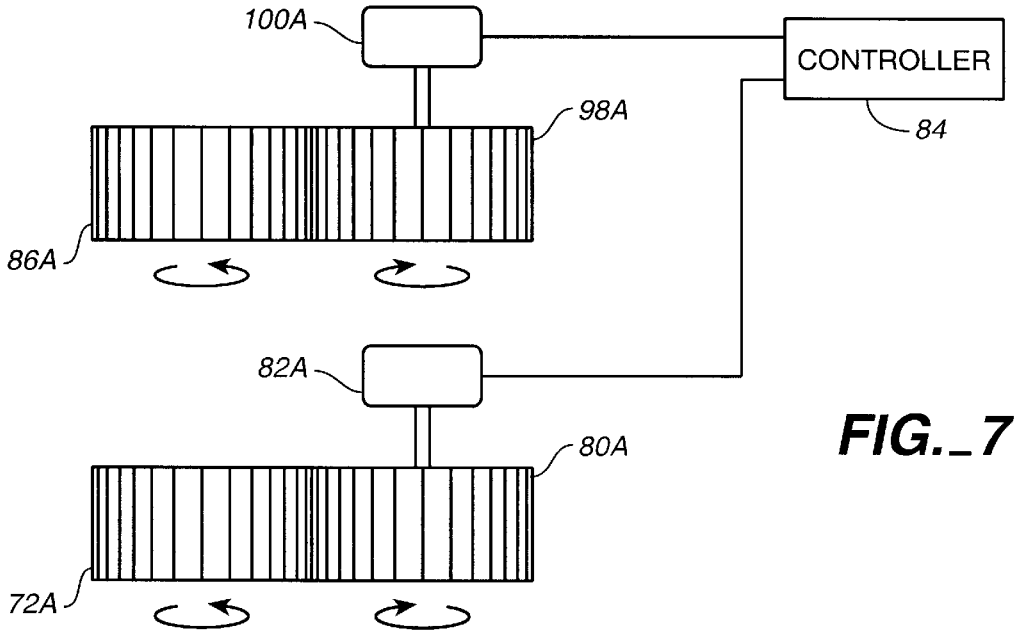
Figure 5A:
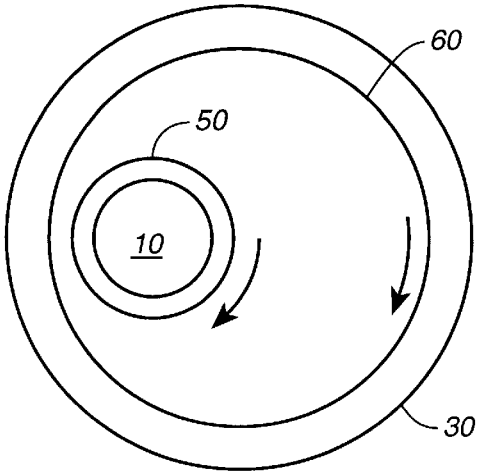
FIGS. 5A through 5D illustrate exemplary movement of the carrier head drive with respect to a polishing pad.
Figure 5B:
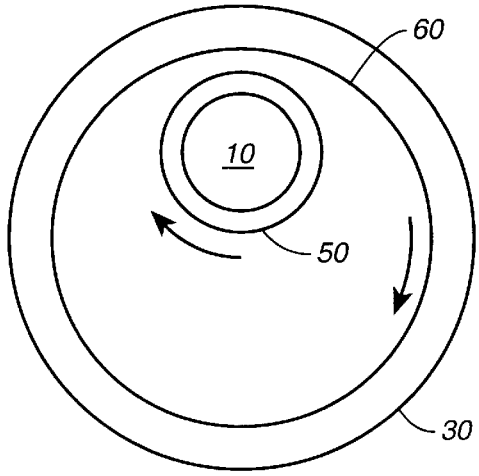
Figure 5C:
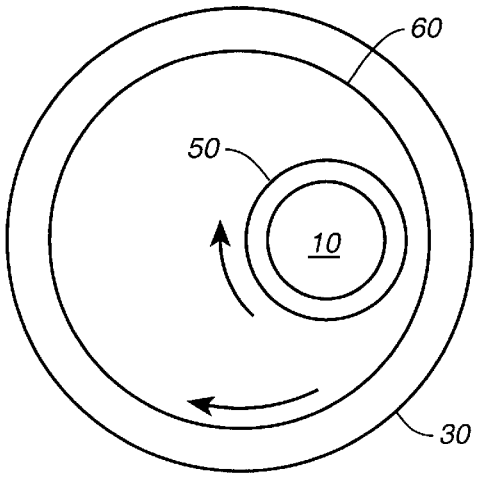
Figure 5D:
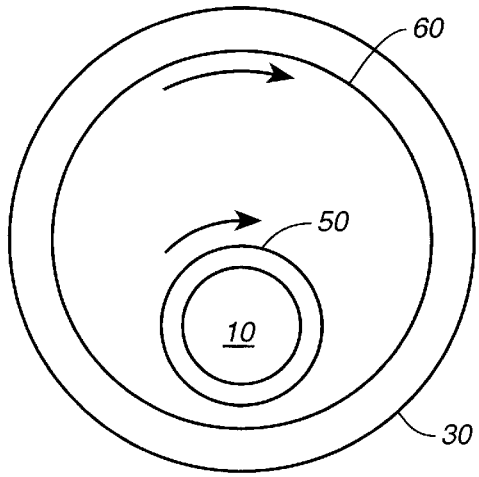
Figure 6:
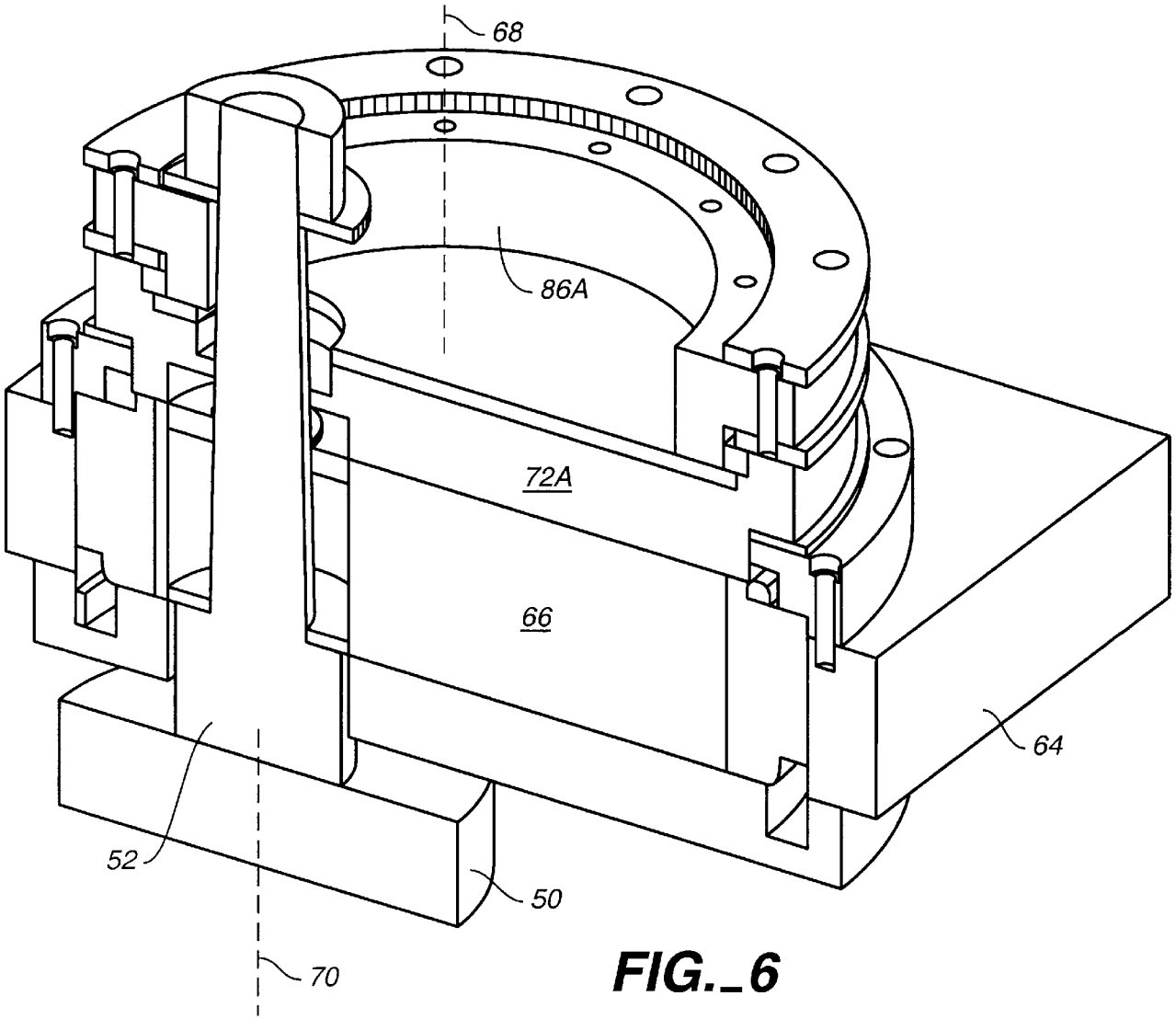

As shown in FIGS. 6 and 7, the system of input pulleys 72, 86 and the corresponding output pulleys 80, 98 connected by the respective belts 78, 96 can be replaced by input gears 72A, 86A that are driven by corresponding driving gears 80A, 98A. The driving gears 80A, 98A are controlled by respective variable speed motors 82A, 100A whose speeds are controlled by the controller 84. The controller 84, therefore, regulates the rotational speeds of the gears 72A, 86A. The operation of the carrier head 50A of FIGS. 6 and 7 is substantially the same as that described above. Thus, the first gear 72A is coupled to the drive shaft 52 to drive the carrier head 50A about its central axis 70. The second gear 80A is coupled to the carrier head 50A to drive the carrier head in a circular path about a point that is offset from the central axis 70 of the carrier head. The controller 84 is operable to cause movement of the carrier head 50 in the circular path at a speed that is independently controllable from the speed at which the carrier head is rotated about its central axis.

The invention has been described in terms of a number of implementations. The invention, however, is not limited to the implementations depicted and described. Other implementations are within the scope of the following claims.

What is claimed is:

1. A wafer polishing apparatus comprising:

a carrier head having a central axis;

a drive shaft secured to the carrier head;

a first input pulley coupled to the drive shaft to drive the carrier head about its central axis; and a second input pulley coupled to the carrier head to drive the carrier head in a circular path about a point that is offset from the central axis of the carrier head.

2. The apparatus of claim 1 including a controller to regulate speeds of the first and second input pulleys.

3. The apparatus of claim 2 wherein the controller is operable to cause movement of the carrier head in the circular path at a speed that is independently controllable from the speed at which the carrier head is rotated about its central axis.

4. The apparatus of claim 3 wherein the controller is operable to cause the carrier head to move in the circular path while the carrier head rotates about its central axis.

5. The apparatus of claim 4 including a polishing pad, wherein the controller is operable to cause rotation of the carrier head about its central axis and movement of the carrier head in the circular path while the wafer is held in contact with the polishing pad.

6. The apparatus of claim 1 including:

an outer gear coupled to the first input pulley;

an inner gear coupled to the drive shaft, wherein the outer gear has teeth that mesh with corresponding teeth of the inner gear;

a cylindrical plate having a hole parallel to its major axis, wherein the drive shaft extends through the hole; and a first annular bearing disposed about and in contact with the circumference of the cylindrical plate, wherein the first annular bearing is coupled to the second input pulley; and wherein the second input pulley is positioned above the cylindrical plate and holds an inner race of the first annular bearing against the cylindrical plate, and wherein a second annular bearing is positioned between a downwardly extending section of the first input pulley and an upwardly extending section of the second input pulley.

7. A wafer polishing apparatus comprising:

a carrier head having a central axis;

a drive shaft coupled to the carrier head;

a first input pulley coupled to the drive shaft to drive the carrier head about its central axis;

a second input pulley coupled to the carrier head to drive the carrier head in a circular path about a point that is offset from the central axis of the carrier head;

a controller to regulate speeds of the first and second input pulleys;

a first output pulley;

a first belt extending from the first input pulley to the first output pulley;

a first variable speed motor coupled to the first output pulley and controlled by the controller;

a second output pulley;

a second belt extending from the second input pulley to the second output pulley; and a second variable speed motor coupled to the second output pulley and controlled by the controller.

8. A wafer polishing apparatus comprising:

a carrier head having a central axis;

a drive shaft secured to the carrier head;

a first input pulley coupled to the drive shaft to drive the carrier head about its central axis;

a second input pulley coupled to the carrier head to drive the carrier head in a circular path about a point that is offset from the central axis of the carrier head;

an outer gear coupled to the first input pulley; and an inner gear coupled to the drive shaft, wherein the outer gear has teeth that mesh with corresponding teeth of the inner gear.

9. A wafer polishing apparatus comprising:

a carrier head having a central axis;

a drive shaft coupled to the carrier head;

a first input pulley coupled to the drive shaft to drive the carrier head about its central axis;

a second input pulley coupled to the carrier head to drive the carrier head in a circular path about a point that is offset from the central axis of the carrier head;

a cylindrical plate having a hole parallel to its major axis, wherein the drive shaft extends through the hole; and a first annular bearing disposed about and in contact with the circumference of the cylindrical plate, wherein the first annular bearing is coupled to the second input pulley.

10. The apparatus of claim 9 including at least one bearing disposed about the drive shaft and disposed between the cylindrical plate and the drive shaft to allow the drive shaft to rotate about its axis.

11. The apparatus of claim 9 wherein the second input pulley is positioned above the cylindrical plate and holds an inner race of the first annular bearing against the cylindrical plate.

12. The apparatus of claim 9 wherein a second annular bearing is positioned between a downwardly extending section of the first input pulley and an upwardly extending section of the second input pulley.

13. A wafer polishing apparatus comprising:

a wafer polishing station including a platen and a polishing pad disposed on the platen;

a carrier head having a central axis;

a drive shaft secured to the carrier head;

a first input pulley coupled to the drive shaft to drive the carrier head about its central axis;

a second input pulley coupled to the carrier head to rotationally drive the carrier head in a circular path about a point that is offset from the central axis of the carrier head; and a controller to regulate speeds of the first and second input pulleys and operable to cause rotation of the carrier head about its central axis and movement of the carrier head in the circular path while the wafer is held in contact with the polishing pad.

14. The apparatus of claim 13 including:

a first output pulley;

a first belt extending from the first input pulley to the first output pulley;

a first variable speed motor coupled to the first output pulley and controlled by the controller;

a second output pulley;

a second belt extending from the second input pulley to the second output pulley; and a second variable speed motor coupled to the second output pulley and controlled by the controller.

15. The apparatus of claim 13 wherein the controller is operable to cause movement of the carrier head in the circular path at a speed that is independently controllable from the speed at which the carrier head is rotated about its central axis.

16. The apparatus of claim 13 including:

an outer gear coupled to the first input pulley; and an inner gear coupled to the drive shaft, wherein the outer gear has teeth that mesh with corresponding teeth of the inner gear.

17. A method of polishing a wafer comprising:

holding the wafer in a carrier head having a central axis;

bringing the wafer into contact with a polishing pad; and rotating the carrier head about its central axis and simultaneously moving the carrier head in a circular path about a point that is offset from the central axis of the carrier head when the wafer is in contact with the polishing pad, wherein, rotating the carrier head about its central axis includes driving a first pulley at a first speed, and therein moving the carrier head in the circular path includes driving a second pulley at a second speed.

18. The method of claim 17 wherein the carrier head moves in the circular path at a speed that is independently controllable from the speed at which the carrier head is rotated about it central axis.

19. The method of claim 17 including rotating the polishing pad when it is in contact with the wafer.

20. The method of claim 17 wherein driving the first pulley drives a gear coupled to the carrier head through a drive shaft.

21. The method of claim 17 wherein rotating the carrier head about its central axis includes driving a first pulley at a first speed, wherein moving the carrier head in the circular path includes driving a second pulley at a second speed, and wherein the first speed is independently controllable from the second speed.

* * * * *